US009872112B2

(12) United States Patent
Bolognia et al.

(10) Patent No.: US 9,872,112 B2
(45) Date of Patent: Jan. 16, 2018

(54) NOISE MITIGATING MICROPHONE SYSTEM

(71) Applicant: Invensense, Inc., San Jose, CA (US)

(72) Inventors: David Bolognia, North Andover, MA (US); Brian Moss, Skehacreggaun (IE)

(73) Assignee: INVENSENSE, INC., San Jose, CA (US)

( * ) Notice: Subject to any disclaimer, the term of this patent is extended or adjusted under 35 U.S.C. 154(b) by 0 days.

(21) Appl. No.: 14/922,073

(22) Filed: Oct. 23, 2015

(65) Prior Publication Data

US 2016/0050499 A1 Feb. 18, 2016

Related U.S. Application Data

(63) Continuation of application No. 13/755,795, filed on Jan. 31, 2013, now Pat. No. 9,173,024.

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| ***H04R 25/00*** | (2006.01) |
| ***H04R 3/00*** | (2006.01) |
| ***H04R 5/027*** | (2006.01) |
| ***H04R 19/00*** | (2006.01) |

(Continued)

(52) U.S. Cl.

CPC ..... *H04R 19/04* (2013.01); *H04R 3/002* (2013.01); *H04R 5/027* (2013.01); *H04R 19/005* (2013.01); *H04R 1/04* (2013.01); *H04R 1/10* (2013.01); *H04R 3/005* (2013.01); *H04R 25/00* (2013.01); *H04R 2201/003* (2013.01); *H04R 2410/05* (2013.01)

(58) Field of Classification Search

CPC ..... H04R 19/005; H04R 19/04; H04R 1/04; H04R 1/10; H04R 2201/003; H04R 2410/05; H04R 25/00; H04R 3/002; H04R 3/005; H04R 5/027

USPC ..... 381/174

See application file for complete search history.

(56) References Cited

U.S. PATENT DOCUMENTS

| | | | |
|---|---|---|---|
| 3,688,863 | A | 9/1972 | Johnson |
| 5,888,187 | A | 3/1999 | Jaeger et al. |

(Continued)

FOREIGN PATENT DOCUMENTS

| | | |
|---|---|---|
| WO | WO20122011589 | 1/2012 |

*Primary Examiner* — Khai N Nguyen

(74) *Attorney, Agent, or Firm* — Maryam Imam; Klintworth & Rozenblat IP LLP

(57) ABSTRACT

A microphone system has a package with a top, a bottom, and four sides that at least in part form an interior chamber. One of the sides forms an inlet aperture for communicating the inlet chamber with the exterior environment. The system also has first and second microphone dies, in a stacked relationship, respectively having a first and second diaphragms. A circuit die, positioned in electrical communication with the first and second microphone dies, is configured to mitigate vibrational noise from the first microphone die using a signal produced by the second microphone die or vice versa. The first and second microphone dies are positioned so that the first and second diaphragms are substantially the same distance from the inlet aperture in the side.

27 Claims, 10 Drawing Sheets

(51) Int. Cl.
*H04R 1/04* (2006.01)
*H04R 1/10* (2006.01)

(56) References Cited

U.S. PATENT DOCUMENTS 6,075,867 A * 6/2000 Bay ..... H04R 19/00 181/171
6,401,545 B1 * 6/2002 Monk ..... G01L 19/0038 73/706
6,422,991 B1 7/2002 Jaeger
6,829,131 B1 12/2004 Loeb et al.
7,072,482 B2 7/2006 Van Doorn et al.
RE42,347 E * 5/2011 Rombach ..... H04R 19/005 367/174
8,223,981 B2 7/2012 Haila et al.
8,270,634 B2 9/2012 Harney et al.
8,351,632 B2 1/2013 Harney et al.
8,477,983 B2 7/2013 Weigold et al.
8,831,246 B2 * 9/2014 Josefsson ..... H04R 3/00 381/107
9,167,228 B2 * 10/2015 Monari ..... H04N 5/2252
9,173,024 B2 * 10/2015 Bolognia ..... H04R 3/002
2004/0232455 A1 * 11/2004 DCamp ..... B81C 1/00333 257/222
2007/0003081 A1 1/2007 Ram et al.
2007/0230734 A1 * 10/2007 Beard ..... H04R 1/04 381/361
2007/0240473 A1 * 10/2007 Taniyama ..... B21C 37/151 72/181
2008/0192963 A1 8/2008 Sato
2008/0217709 A1 * 9/2008 Minervini ..... B81B 7/0061 257/416
2009/0152655 A1 * 6/2009 Laming ..... B81C 1/00246 257/416
2010/0059877 A1 * 3/2010 Leib ..... B81C 1/0023 257/704
2010/0080405 A1 4/2010 Wu et al.
2010/0135514 A1 * 6/2010 Hinke ..... H04R 19/04 381/355
2011/0108933 A1 * 5/2011 Nakatani ..... B81C 1/00238 257/415
2011/0142261 A1 * 6/2011 Josefsson ..... H04R 3/00 381/107
2012/0003791 A1 * 1/2012 Leib ..... B81C 1/0023 438/106
2012/0049298 A1 * 3/2012 Schlarmann ..... B81C 1/00309 257/415
2012/0126347 A1 * 5/2012 Yang ..... B81B 7/0064 257/416
2012/0193733 A1 * 8/2012 Nakatani ..... H01L 29/84 257/415
2012/0237073 A1 * 9/2012 Goida ..... H04R 1/02 381/361
2013/0127879 A1 * 5/2013 Burns ..... G01L 9/0051 345/501
2013/0136280 A1 * 5/2013 Stephanou ..... H04R 17/00 381/190
2013/0155629 A1 * 6/2013 Ru ..... H01L 23/10 361/746
2013/0161702 A1 * 6/2013 Chen ..... B81C 1/00246 257/254
2013/0270427 A1 * 10/2013 Hsiao ..... H01L 31/0203 250/227.28
2013/0320463 A1 * 12/2013 Chang ..... H01L 24/97 257/415
2013/0330878 A1 * 12/2013 Ararao ..... H01L 21/56 438/107
2014/0042565 A1 * 2/2014 Fuergut ..... H04R 19/005 257/416
2014/0117469 A1 * 5/2014 Takahashi ..... B81C 1/0023 257/415
2014/0183671 A1 * 7/2014 Kuratani ..... H01L 23/552 257/416
2014/0210020 A1 * 7/2014 Dehe ..... B81B 3/007 257/416
2014/0211957 A1 7/2014 Bolognia et al.
2014/0299948 A1 * 10/2014 Wang ..... H04R 19/005 257/416
2014/0311238 A9 * 10/2014 Bonnat ..... G01P 5/04 73/272 R
2014/0355095 A1 * 12/2014 Naftali ..... B81B 7/0067 359/225.1

* cited by examiner

NOISE MITIGATING MICROPHONE SYSTEM

PRIORITY

This application is a continuation application of U.S. patent application Ser. No. 13/755,795, filed on Jan. 31, 2013, by David Bolognia, et al. and entitled "Noise Mitigating Microphone System", now U.S. Pat. No. 9,173,024, the disclosure of which is incorporated herein, in its entirety, by reference.

FIELD OF THE INVENTION

The invention generally relates to microphones and, more particularly, the invention relates to packages for microphones.

BACKGROUND OF THE INVENTION

MEMS microphones are used in a growing number of devices, such as mobile telephones, laptop computers, voice recorders, hearing instruments, and other electronic devices. To those ends, MEMS microphone dies typically are mounted within a package interior and controlled by an adjacent integrated circuit die. For example, a MEMS microphone package may include a substrate, such as an FR-4 based printed circuit board (PCB), a MEMS microphone die attached to the substrate, and a cup-shaped lid attached to the substrate to create a package. The interior of the package forms an interior chamber that protects the fragile MEMS microphone die from the environment.

The interior chamber is not completely isolated, however, from the external environment. Specifically, the package also has an aperture to permit communication between the microphone die and an acoustic signal generated outside of the package. For example, to permit access of an acoustic signal into the package, the substrate may form a through-hole aperture under the microphone die. The acoustic signal thus enters through the aperture, and strikes the diaphragm portion of the microphone die, causing the die to generate corresponding electrical signals.

Ergonomic considerations of an underlying device (e.g., a hearing instrument) often can cause the microphone aperture to be located in a region or wall with very little clearance. The art has responded to this by locating some microphone package apertures in the smaller side walls of the package. Moreover, certain devices undesirably cause a significant amount of noise. For example, hearing aids can cause noise simply due to the normal movement of a user.

SUMMARY OF VARIOUS EMBODIMENTS

In accordance with one embodiment of the invention, a microphone system has a package forming an interior chamber and an inlet aperture for communicating the inlet chamber with the exterior environment (i.e., the environment outside of the interior chamber). The system also has first and second MEMS microphones in a stacked relationship within the interior chamber. The first MEMS microphone has a first movable diaphragm and a first backplate that together form a first variable capacitor. Likewise, the second MEMS microphone has a second movable diaphragm and a second backplate that together form a second variable capacitor. Both the first and second MEMS microphones are in fluid communication with the inlet aperture. The first MEMS microphone is configured to produce a first signal in response to receipt of an incoming acoustic signal striking the first diaphragm, and, in a similar manner, the second MEMS microphone is configured to produce a second signal in response to receipt of the incoming acoustic signal striking the second diaphragm. The first and second diaphragms are positioned substantially the same distance from the inlet aperture.

To receive the first and second signals, the microphone system also may have at least one noise mitigating circuit, within the interior chamber, electrically connected with the first and second MEMS microphones. The noise mitigating circuitry may be configured to use the first signal to mitigate noise in the second signal. The noise mitigating circuitry also may be configured to use the second signal to mitigate noise in the first signal. Alternatively, or in addition, the noise mitigating circuitry may combine an inverted version of the first signal with the second signal to produce an output microphone signal.

The first MEMS microphone and the second MEMS microphone illustratively are configured to have identical responses to an incoming acoustic signal. In addition, the system also may have a device housing configured for connection with a person's ear. In that case, the system also may have a speaker within the housing, and controls for controlling the microphone die and speaker.

Some implementations of the package have a top, a bottom, and a plurality of sides, where at least one of the sides forms the inlet aperture. Moreover, the interior chamber may form a back volume to which both the first and second MEMS microphones are exposed. Among other things, the package may have a lid secured to a base, where one or both of the base and lid include injection molded material and conductive material to mitigate electromagnetic interference.

The system also may have a substrate secured with the package. The substrate can be within the interior chamber and extend out of the interior chamber—to the exterior environment. Also, some embodiments position the MEMS microphones so that the first diaphragm is adjacent to the second diaphragm.

In accordance with another embodiment of the invention, a microphone system has a package with a top, a bottom, and four sides that at least in part form an interior chamber. One of the sides forms an inlet aperture for communicating the inlet chamber with the exterior environment. The system also has first and second microphone dies, in a stacked relationship, respectively having a first and second diaphragms. A circuit die, positioned in electrical communication with the first and second microphone dies, is configured to mitigate noise from the first microphone die using a signal produced by the second microphone die. The first and second microphone dies are positioned so that the first and second diaphragms are substantially symmetrically positioned relative to the inlet aperture.

In accordance with other embodiments, a microphone system includes first and second package portions respectively having first and second bases respectively secured to a first and second lids. These bases and lids form first and second interior chambers respectively containing first and second microphone dies. The first and second bases respectively form first and second apertures in fluid communication with the first and second microphones, respectively. The first base is coupled with the second base to form a primary package. Specifically, the bases are coupled so that the first aperture is adjacent to, generally parallel with, and in a different plane than the second aperture. The primary package forms an inlet aperture and a channel extending from the inlet aperture. This channel extends at least to the first and second apertures, and the first and second apertures are positioned substantially the same distance from the inlet aperture.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, a packaged microphone/microphone system has two microphones that cooperate to mitigate noise, such as vibrational noise, from its output signal. To that end, the packaged microphone has two microphone dies that each receives the same incoming acoustic signal at substantially the same time. For example, the diaphragms on both microphone dies may receive an incident acoustic signal at the same time. Circuitry combines the output signals of both dies to mitigate the noise and, in some instances, increase the desired signal. The packaged microphone can be implemented as a part of a wide variety of devices, such as mobile telephone and hearing aids. Details of illustrative embodiments are discussed below.

Figure 1A:
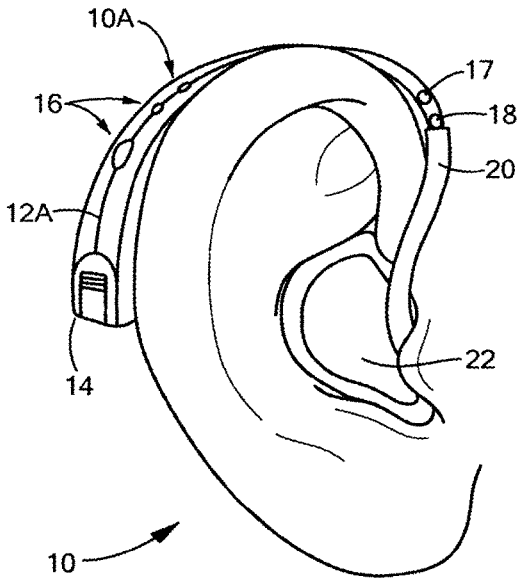
FIGS. 1A-1D schematically show a plurality of different types of hearing aids that may incorporate illustrative embodiments of the invention.
Figure 1B:
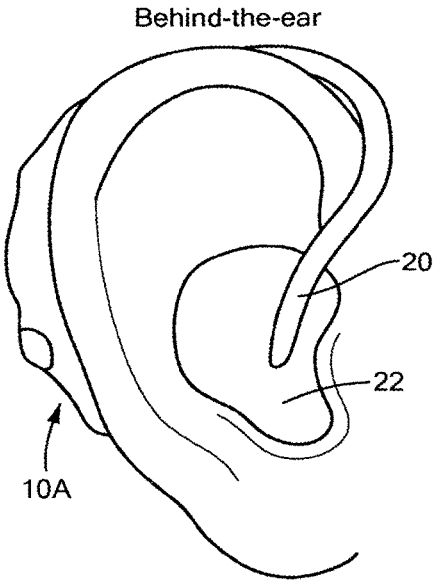
Figure 1C:
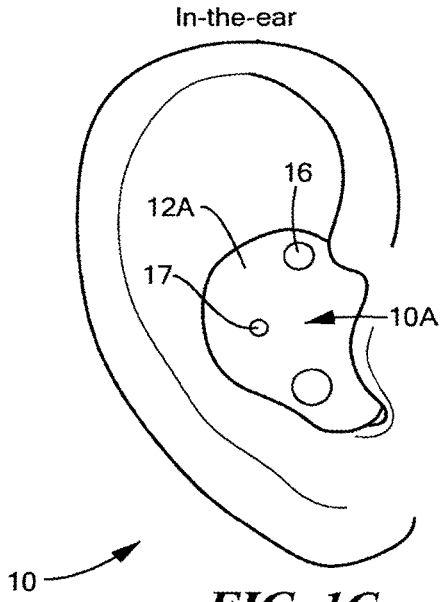
Figure 1D:
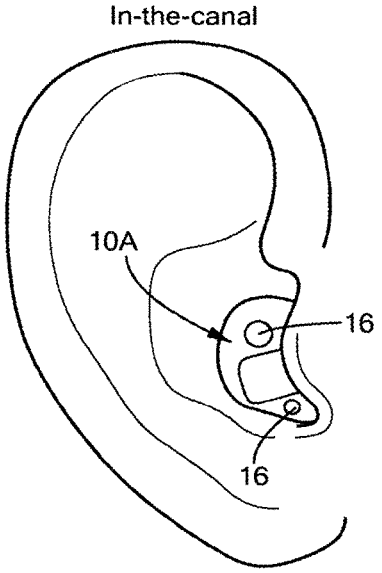

FIGS. 1A-1D illustratively show various different types of hearing aids 10A that may incorporate microphone systems implementing illustrative embodiments of the invention. FIGS. 1A and 1B show different "behind the ear" types of hearing aids 10A that, as their name suggests, have a significant portion secured behind a person's ear during use. In contrast, FIGS. 1C and 1D show hearing aids 10A that do not have a component behind the ear. Instead, these types of hearing aids 10A mount within the ear. Specifically, FIG. 1C shows an "in-the-ear" hearing aid 10A which, as its name suggests, mounts in-the-ear, while FIG. 1D shows an "in-the-canal" hearing aid 10A which, as its name suggests, mounts more deeply in the ear—namely, in the ear canal.

With reference to FIG. 1A, the intelligence, sensors (e.g., microphone systems 17, discussed in greater detail below with regard to FIGS. 3-7), and logic of the behind the ear type of hearing aid 10A lies primarily within a housing 12A that mounts behind the ear. To that end, the housing 12A forms an interior that contains internal electronics for processing audio signals, a battery compartment 14 (a powering module) for containing a battery (not shown) that powers the hearing aid 10A, and mechanical controlling features 16, such as knobs, for controlling the internal electronics. In addition, the hearing aid 10A also includes a microphone system 17 (e.g., including a packaged microphone die, also referred to using reference number 17) for receiving audio signals, and a speaker 18 for transmitting amplified audio signals received by the packaged microphone 17 and processed by the internal electronics. A hollow tube 20 directly connected to the end of the hearing aid 10A, right near the speaker 18, channels these amplified signals into the ear. To maintain the position of this tube 20 and mitigate undesired feedback, the hearing aid 10A also may include an ear mold 22 (also part of the body of the hearing aid 10A) formed from soft, flexible silicone molded to the shape of the ear opening.

Among other things, the hearing aid 10A may have circuitry and logic for optimizing the signal generated through the speaker 18. More specifically, the hearing aid 10A may have certain program modes that optimize signal processing in different environments. For example, this logic may include filtering systems that produce the following programs:

normal conversation in a quiet environment,
normal conversation in a noisy environment,
listening to a movie in a theater, and
listening to music in a small area.

The hearing aid 10A also may be programmed for the hearing loss of a specific user/patient. It thus may be programmed to provide customized amplification at specific frequencies. Some of this functionality can be implemented within its internal microphone system 17.

The other two types of hearing aids 10A typically have the same internal components, but in a smaller package. Specifically, the in-the-ear hearing aid 10A of FIG. 1C has a flexible housing 12A, with the noted internal components, molded to the shape of the ear opening. In particular, among other things, those components include a packaged microphone 17 facing outwardly for receiving audio signals, a speaker (not shown) facing inwardly for transmitting those signals into the ear, and internal logic for amplifying and controlling performance.

The in-the-canal hearing aid 10A of FIG. 1D typically has all the same components, but in a smaller package to fit in the ear canal. Some in-the-canal hearing aids 10A also have an extension (e.g., a wire) extending out of the ear to facilitate hearing aid removal. Because they fit in tight spots (e.g., behind the ear or in the ear canal), space for internal system components (e.g., microphones) is at a premium.

Figure 2:
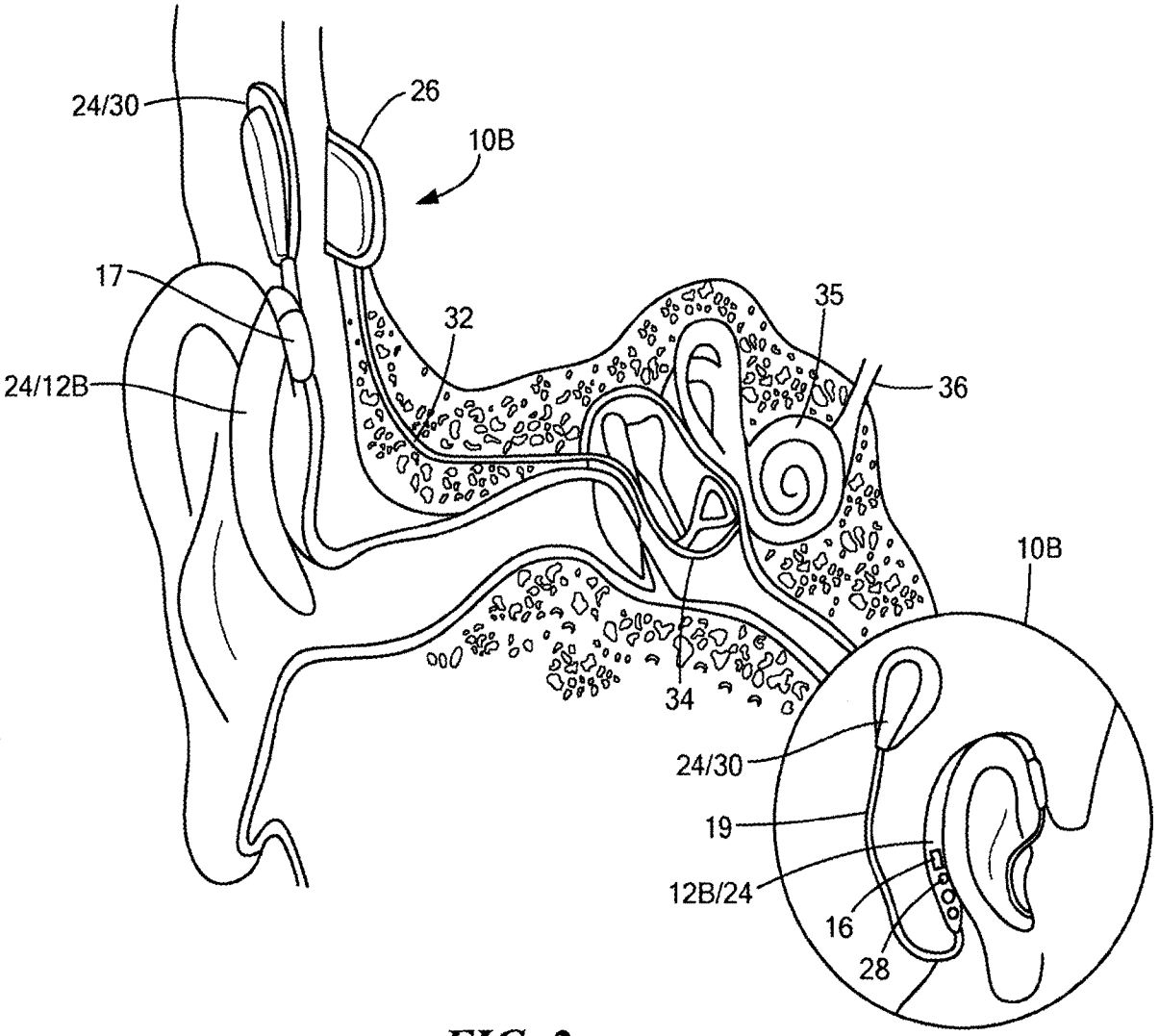
FIG. 2 schematically shows one example of a cochlear implant that may incorporate illustrative embodiments of the invention.

FIG. 2 schematically shows another type of hearing instrument, a cochlear implant 10B, which, in a similar manner, also has significant space constraints for its internal components. At a high level, a cochlear implant 10B has the same function as that of a hearing aid 10A; namely, to help a person hear normally audible sounds. A cochlear implant 10B, however, performs its function in a different manner by having an external portion 24 that receives and processes signals, and an implanted portion 26 physically located within a person's head.

To those ends, the external portion 24 of the cochlear implant 10B has a behind the ear portion with many of the same components as those in a hearing aid 10A behind the ear portion. The larger drawing in FIG. 2 shows this behind the ear portion as a transparent member since the ear covers it, while the smaller drawing of that same figure shows it behind the ear.

Specifically, the behind the ear portion includes a housing/body 12B that contains a microphone 17 for receiving audio signals, internal electronics for processing the received audio signals, a battery, and mechanical controlling features 16 (e.g., knobs) for controlling the internal electronics. Those skilled in the art often refer to this portion as the "sound processor" or "speech processor." A wire 19 extending from the sound processor connects with a transmitter 30 magnetically held to the exterior of a person's head. The speech processor communicates with the transmitter 30 via the wire 19.

The transmitter 30 includes a body having a magnet that interacts with the noted implanted metal portion 26 to secure it to the head, wireless transmission electronics to communicate with the implanted portion 26, and a coil to power the implanted portion 26 (discussed below). Accordingly, the packaged microphone 17 in the sound processor receives audio signals, and transmits them in electronic form to the transmitter 30 through the wire 19, which subsequently wirelessly transmits those signals to the implanted portion 26.

The implanted portion 26 thus has a receiver with a microprocessor to receive compressed data from the external transmitter 30, a magnet having an opposite polarity to that in the transmitter 30 both to hold the transmitter 30 to the person's head and align the coils within the external portion 24/transmitter 30, and a coil that cooperates with the coil in the exterior transmitter 30. The coil in the implanted portion 26 forms a transformer with the coil of the external transmitter 30 to power its own electronics. A bundle of wires 32 extending from the implanted portion 26 passes into the ear canal and terminates at an electrode array 34 mounted within the cochlea 35. As known by those skilled in the art, the receiver transmits signals to the electrode array 34 to directly stimulate the auditory nerve 36, thus enabling the person to hear sounds in the audible range of human hearing.

Various embodiments also may apply to other types of hearing instruments, such as receiver-in-canal hearing instruments, which have the speaker outside of the main body. Indeed, illustrative embodiments of the invention may implement microphone systems 17 in a variety of other underlying devices. For example, among other things, the microphone systems 17 discussed herein may be implemented in mobile telephones, smartphones, cameras, computers, gaming systems, and hand-held public announcement ("PA") devices. Accordingly, discussion of hearing instruments or some other higher level system is for exemplary purposes only and not intended to limit all embodiments of the invention.

Figure 3A:
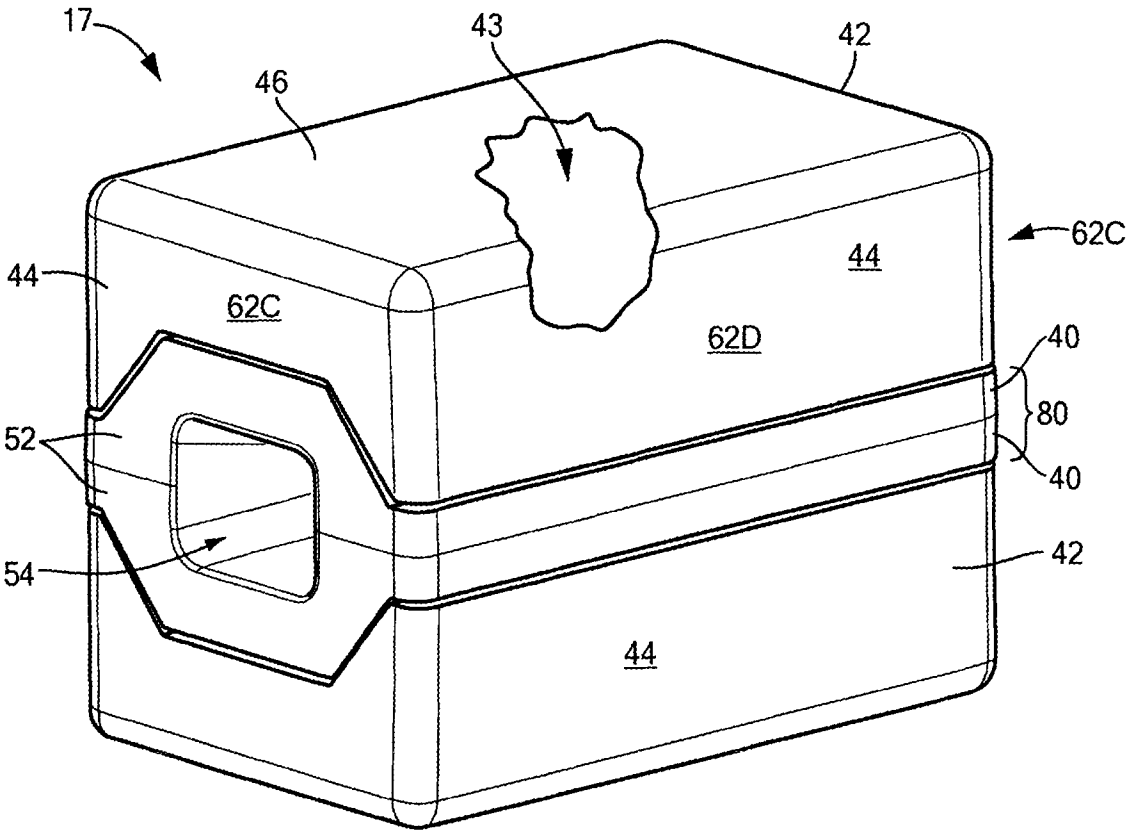
FIG. 3A schematically shows a perspective view of a packaged microphone that may implement illustrative embodiments of the invention.

FIG. 3A schematically shows a perspective view of a packaged microphone system 17 implemented in accordance with illustrative embodiments of the invention. As noted above, the packaged microphone system 17 also may be referred to as a "packaged microphone 17" or a "microphone system 17" either alone or in combination with an underling device, such as a hearing instrument 10. The packaged microphone 17 has a package 38 that may be coupled with an underlying apparatus, such as a printed circuit board within a hearing instrument 10A or 10B or mobile telephone. The underlying apparatus, however, can have any of a variety of other devices (e.g., other integrated circuits). Accordingly, discussion of a printed circuit board is illustrative and not intended to limit a variety of other embodiments.

The package 38 has two portions that may be substantially the same and coupled together. To those ends, each portion has a base 40 that, together with a corresponding lid 42, forms an interior chamber 43 containing at least two dies that together receive and process incoming acoustic signals (see FIGS. 5A and 5B for more details of interior). The interior chamber 43 is shown in FIG. 3A as a cut-away, which is not on the final product. The cut-away is shown simply to highlight the interior chamber 43.

To form the interior chamber 43, the lid 42 has four side walls 44 extending downwardly from a substantially planar top surface 46. In a corresponding manner, the base 40 has a generally planar bottom surface (not shown because both bottom surfaces cover each other, discussed below). One of the side walls 44 of the lid 42 has a specially shaped contour to receive a complementary upwardly extending portion 52 of the base 40. That upwardly extending portion 52 of the base 40 forms a portion of an audio input port 54 (also referred to as an aperture 54, opening 54 or inlet port 54) that enables ingress of audio/acoustic signals into the interior chamber 43.

Figure 3B:
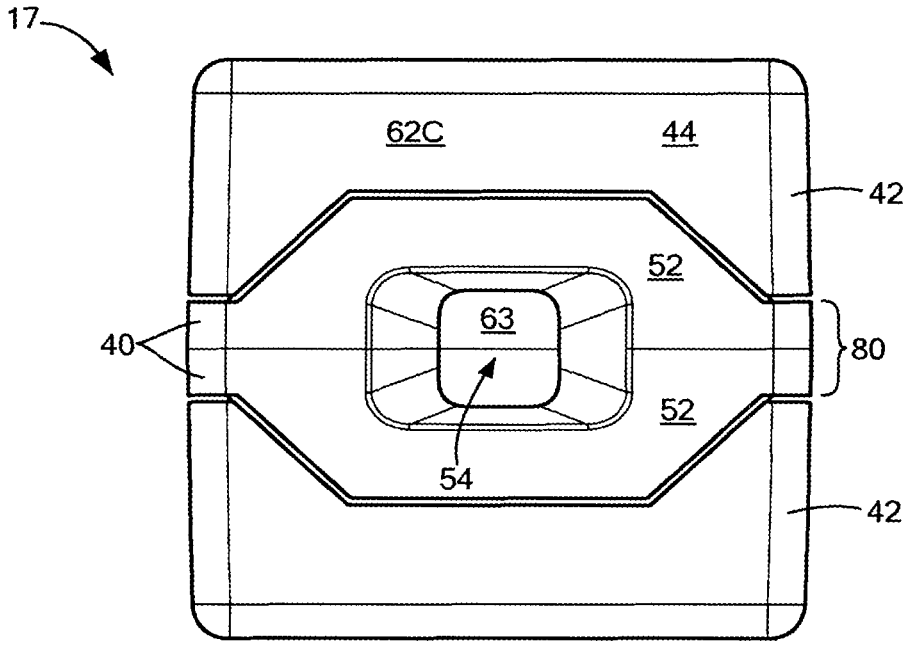
FIG. 3B schematically shows a side, aperture port view of the packaged microphone of FIG. 3A.

The two package portions are coupled back-to-back to form the overall package 38 as shown in FIG. 3A. When coupled, the upwardly extending portions 52 of the bases 40 combine to form halves of the noted inlet port 54 and an acoustic channel 63 that leads to the interior chamber 43. Both bases 40 thus form half or some portion of the acoustic channel 63 that leads to the interior chamber 43. FIG. 3B shows a straight-on view of the side face 62C of the package 38 having the inlet port 54.

The interior chamber 43 of each portion contains a microelectromechanical system microphone die 56 (not shown in this figure, but discussed in detail below with regard to FIGS. 4A and 4B, also known as a "MEMS microphone" or "silicon microphone") for receiving and converting incoming acoustic signals into electronic signals. In illustrative embodiments, the microphone dies 56 in both portions of the package 38 are substantially identical. As such, they should have substantially the same/identical responses when receiving substantially the same acoustic signals. To ensure this congruence, both microphone dies 56 may be fabricated in the same process. MEMS fabrication processes currently practiced should be capable of providing this congruent performance.

The interior chamber 43 also has a circuit die 58 (also not shown in this figure, but discussed with regard to FIGS. 5A and 6) for controlling and processing signals within the system 17. After it is converted into an electrical signal, the acoustic signal is routed out of the package 38 by one or more electrical interconnects through the package 38.

Figure 3C:
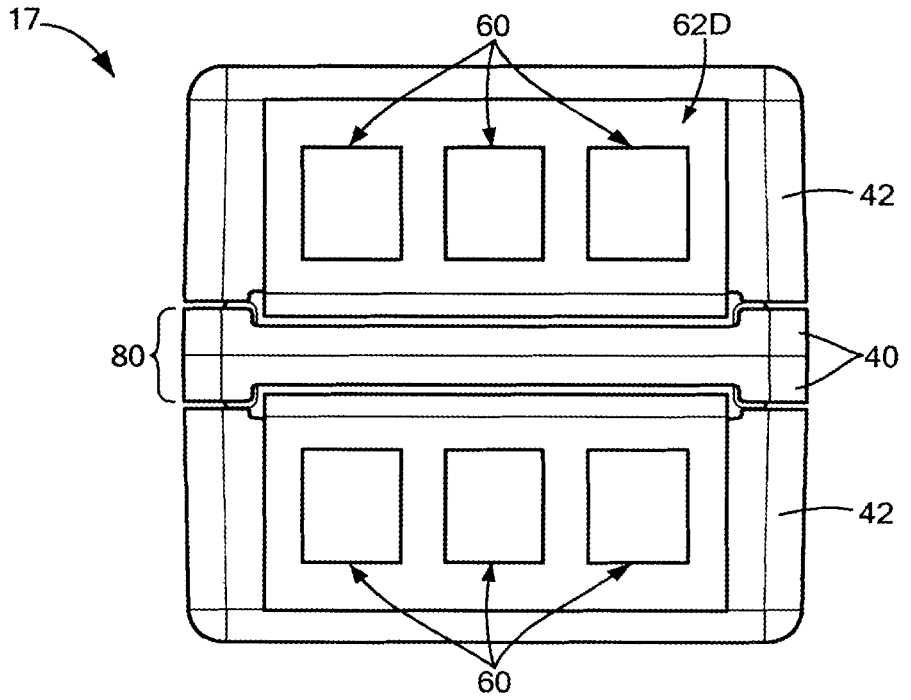
FIG. 3C schematically shows a side, electrical interface view of the packaged microphone of FIG. 3A.

In particular, as shown in FIG. 3C, the opposite side surface of one or both lids 42 has a number of external contacts/bond pads 60 for electrically (and physically, in many anticipated uses) connecting the microphone system 17 with an external apparatus. When the two package portions are combined/coupled, as shown in FIG. 3C, they form an array of pads 60 that are ready for connection with the noted underlying apparatus. This connection may be a surface mounted connection, or some other conventional connection. As noted above, the external apparatus may include a printed circuit board or other electrical interconnect apparatus of the next level device (e.g., of a hearing instrument 10A or 10B or mobile device). Accordingly, during use, the microphone circuit dies 56 and 58 cooperate to convert audio/acoustic signals received within its interior into electrical signals, and route those signals through external contacts/bond pads 60 in the base 40 to a circuit board or other external device.

It should be noted that although six pads 60 are shown, various embodiments can have more or fewer pads 60. Accordingly, discussion of six pads is for illustrative purposes only. For example, some embodiments can have three or four pads 60. The number of pads 60 depends upon a number of factors, such as the functionality required. For example, in a three pin embodiment, most or all of the processing may be executed internally in a single circuit die 58.

The base 40 and lid 42 may be formed at any of a variety of different types of materials known in the art for this purpose. For example, the base 40 and lid 42 may be produced primarily from injection molded plastic. To protect the microphone die 56 from electromagnetic interference, one or both of the base 40 and lid 42 also may have conductive components. For example, each of the base 40 and lid 42 may have a layer of metal on their interior surfaces, or metal integrated into the interior of their bodies. For example, the base 40 and/or lid 42 may be plated with a layer of copper nickel (CuNi). Alternatively, the injection molded material may have embedded conductive particles. Other embodiments may form the base 40 from printed circuit board material, such as FR-4, ceramic, a carrier substrate, a premolded leadframe package, or other known structures commonly used for those purposes. Like the base 40, the lid 42 also may be formed from other materials, such as metal or circuit board material.

Although it may have rounded exterior corners or other minor details (e.g., grooves or bumps), the package 38 is considered to have six substantially planar sides (generally referred to using reference number 62) having exterior faces/surfaces (hereinafter "faces"). In particular, those faces 62 include a top face 62A, a bottom face 62B, and four side faces 62C and 62D. In the embodiment of FIG. 3A, for example, the four side faces 62C and 62D include two smaller side faces 62C (along the width of the package 38) and two larger side faces 62D (along the length of the package 38). Each one of these six faces 62A-62D (i.e., the substantial majority of their surface areas) is perpendicular to all of its respective adjoining faces 62, thus forming a rectangular shape as shown in FIG. 3A. In other embodiments, however, the package 38 may form a shape other than a rectangle.

The planar exterior surface of one of the smaller side faces 62C defines or forms the above noted inlet port 54, which forms an opening/mouth 54 to the above noted acoustic channel 63. As discussed in greater detail below regard to FIG. 5A, this channel 63 extends through the base 40 to direct acoustic signals to the microphone dies 56. In illustrative embodiments, the acoustic channel 63 has a tapered shape, reducing its inner dimension from the inlet port 54 to respective openings/microphone input ports 90 (FIG. 5B, discussed below) adjacent to the microphone dies 56. The acoustic channel 63 illustratively is straight and generally perpendicular to the plane of the noted openings 90 adjacent to the microphone dies 56. It should be noted that discussion of the channel 63 extending through the base 40 is but one of many potential implementations. For example, the channel 63 may extend through the base 40 and lid 42 together, or through the lid 42 alone.

In alternative embodiments, the acoustic channel 63 is formed through one of the other exterior faces 62 (e.g., through the top face 62A, bottom face 62B, or another side face 62C, 62D). Some other embodiments have multiple inlet ports 54 through the same exterior face 62, or through different exterior faces 62. Accordingly, discussion of the inlet port 54 through the smaller side face 62C is not intended to limit all embodiments of the invention.

Figure 4A:
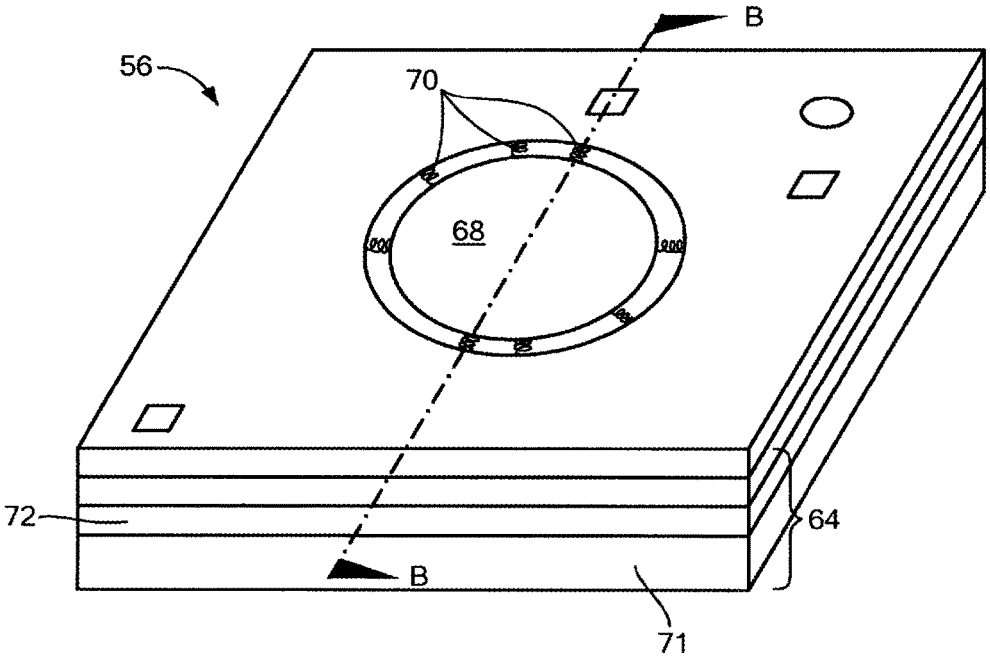
FIG. 4A schematically shows a perspective view of a MEMS microphone that may be used with illustrative embodiments of the invention.
Figure 4B:
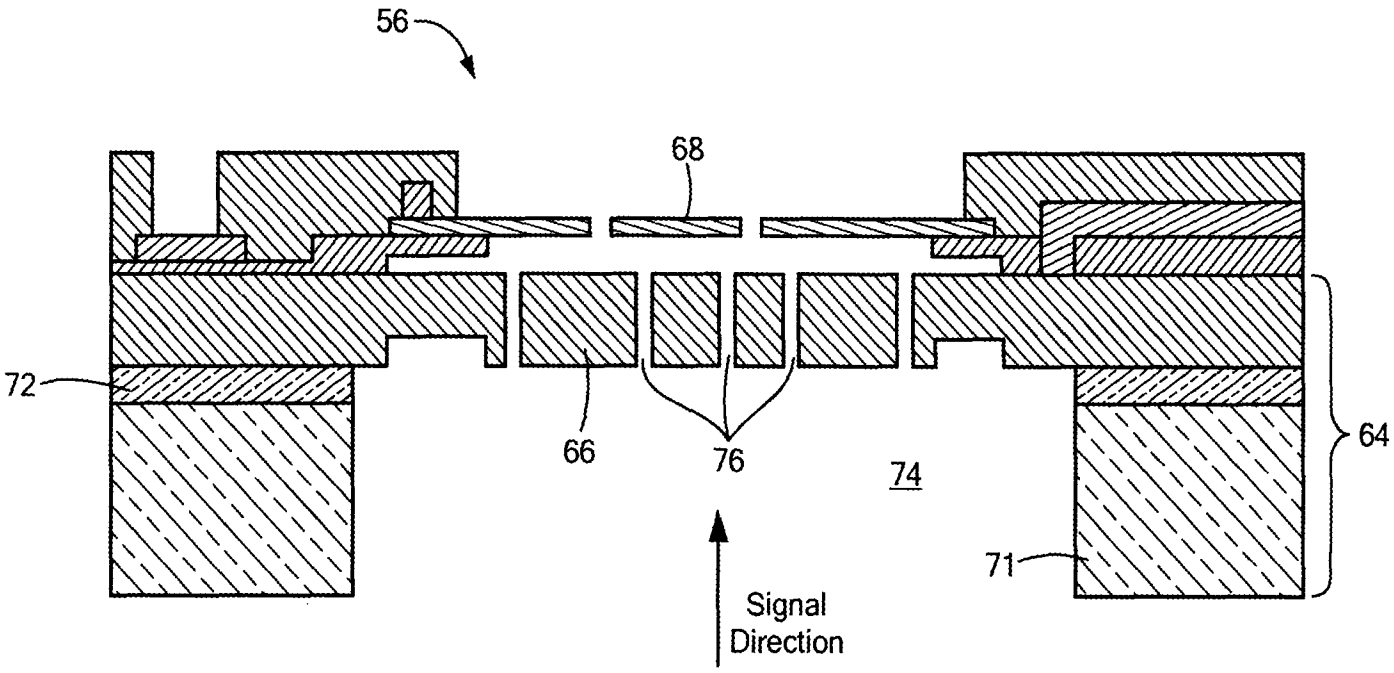
FIG. 4B schematically shows a cross-sectional view of the MEMS microphone of FIG. 5A across line B-B.

Each microphone die 56 may be implemented as any of a number of different types of microphone dies. For example, as suggested above, the microphone die 56 may be implemented as a MEMS microphone die. To that end, FIG. 4A schematically shows a top, perspective view of a MEMS microphone die 56 that may be used with illustrative embodiments of the invention. FIG. 4B schematically shows a cross-sectional view of the same MEMS microphone die 56 across line B-B of FIG. 4A. These two figures are discussed simply to detail some exemplary components that may make up a microphone die 56 that may be used in accordance with various embodiments.

As shown in FIGS. 4A and 4B, the microphone die 56 has a chip base 64, one portion of which supports a backplate 66. The microphone die 56 also includes a flexible diaphragm 68 that is suspended by springs 70 over, and movable relative to, the backplate 66. The backplate 66 and diaphragm 68 together form a variable capacitor. In illustrative embodiments, the backplate 66 is formed from single crystal silicon (e.g., a part of a silicon-on-insulator wafer), while the diaphragm 68 is formed from deposited polysilicon. In other embodiments, however, the backplate 66 and diaphragm 68 may be formed from different materials.

In the embodiment shown in FIGS. 4A and 4B, the chip base 64 includes the backplate 66 and other structures, such as a bottom wafer 71 and a buried oxide layer 72 of a silicon-on-insulator (i.e., a SOI) wafer. A portion of the chip base 64 also forms a backside cavity 74 extending from the bottom of the chip base 64 to the bottom of the backplate 66. To facilitate operation, the backplate 66 has a plurality of through-holes 76 that lead to the backside cavity 74.

In operation, as generally noted above, audio/acoustic signals strike the diaphragms 68 of each microphone die 56 at substantially the same time, causing them to vibrate, thus varying the distance between their respective diaphragms 68 and the backplates 66 to produce a changing capacitance. In illustrative embodiments, if mounted and configured properly, these changing capacitance signals are substantially in phase with each other (discussed in greater detail below with regard to FIG. 6). Such audio signals may contact the microphone die 56 from any direction. For example, the acoustic signals may travel upward, first through the backplate 66, and then partially through and against the diaphragm 68. As another example, the microphone dies 56 may be oriented so that the acoustic signals may travel in the opposite direction.

It should be noted that discussion of a specific microphone die 56 is for illustrative purposes only. Other microphone configurations thus may be used with illustrative embodiments of the invention. For example, rather than using an SOI wafer, the microphone die 56 may be formed from a bulk silicon wafer substrate, and/or the backplate 66 may be formed from a deposited material, such as deposited polysilicon.

Figure 5A:
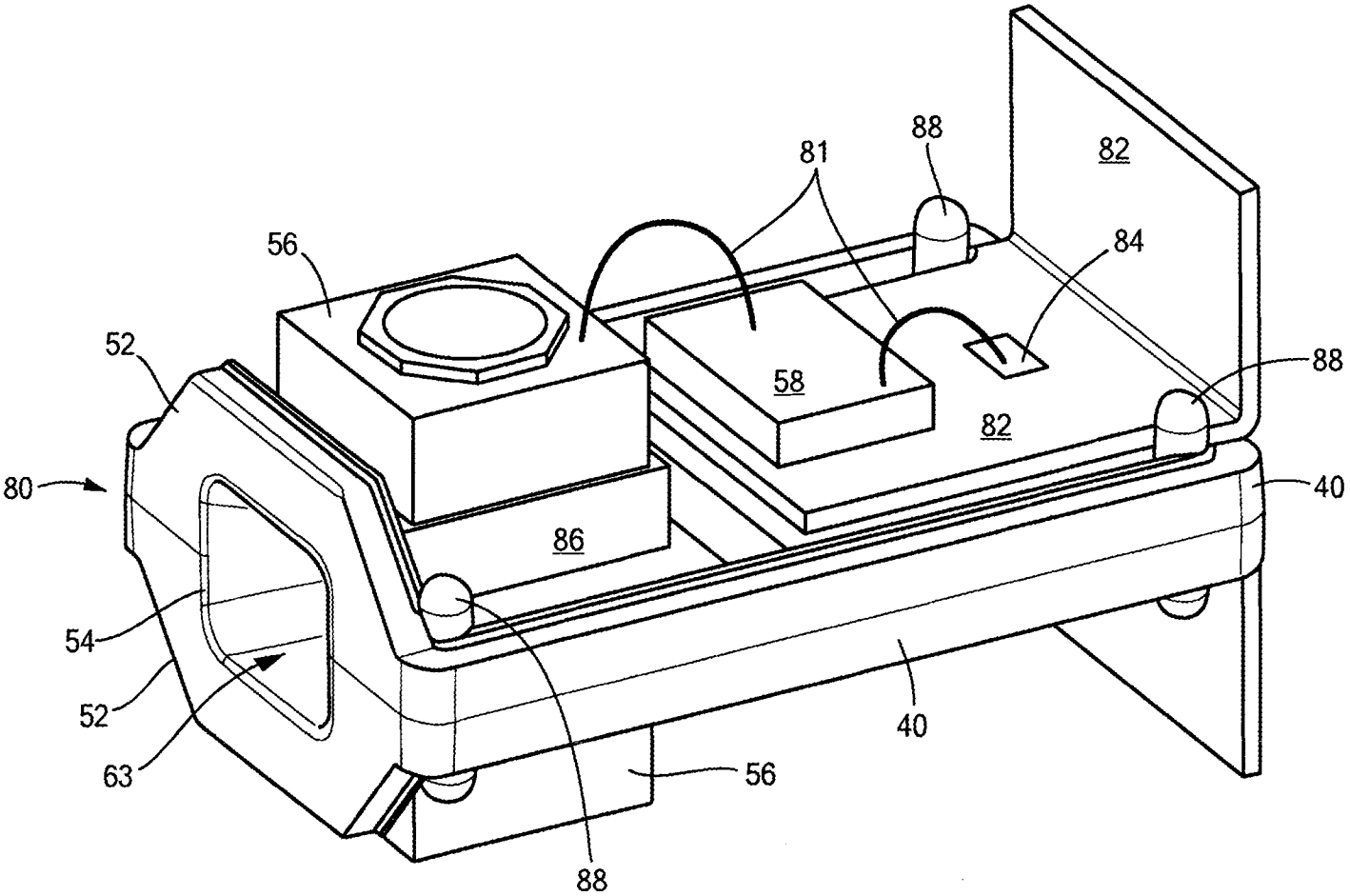
FIG. 5A schematically shows the packaged microphone of FIG. 3A with its lid removed to show the internal components.

FIG. 5A schematically shows the packaged microphone 17 of FIG. 3A with its lid 42 removed to show the internal components. As noted above, this portion of the package 38 has two complementary bases 40 secured together to form the input port 54. Specifically, the two bases 40 are coupled back-to-back to form a single, substantially unitary base 80 supporting components on its top and bottom surfaces. To facilitate this connection, the abutting sides of the bases 40 may have complementary features (not shown) that ensure a close tolerance. For example, the bottom surface of the top base 40 may have a plurality of locking members or a prescribed pattern of bumps, while the top surface of the bottom base 40 may have a corresponding pattern of locking apertures that are precisely lined up with the locking members of the top base 40. To facilitate production, it is anticipated that both bases 40 would have locking members and locking apertures.

The top and bottom surfaces of this combined, unitary base 80 illustratively has the same arrangement of components. Accordingly, for simplicity, only the top surface is discussed and shown in detail in FIG. 5A. It nevertheless should be noted that both surfaces have microphone dies 56, circuit chips 58, and similar components to those discussed for the top surface. Some embodiments, however, may have different components.

As shown, the base 40 has a mounting pedestal 86 for supporting the MEMS microphone die 56, and a generally flat region supporting a substrate 82 containing the circuit die 58, which may include an application-specific integrated circuit ("ASIC 58"). Wire bonds 59 or other interconnects electrically connect the microphone die 56 with the ASIC 58.

Among other things, the substrate 82 may be formed from a circuit board material, such as a flex circuit board. The flexible circuit board 82 in this embodiment extends to the edge of the base 40 from within the interior chamber 43 to the exterior side face 62D of the package 38. Accordingly, the flex circuit board provides the necessary electrical interconnects from the interior chamber 43 to the exterior of the package 38. To that end, the flex circuit board has a plurality of internal pads 84 for electrically connecting with the dies 56 and 58, and a plurality of external pads 60 for mounting to an external device (e.g., a surface mount connection). Alternative embodiments, however, may provide electrical interconnects directly through the base 40 or lid 42, terminating at surface mountable pads (or other exterior interconnects, such as pins) on the bottom, top, and/or side faces 62A-62D of the package 38. In yet other embodiments, the substrate 82 does not extend outside of the interior chamber 43. Some embodiments even have a single substrate 82 for components on both sides of the base 40. For example, such embodiments may have a single substrate 82 supporting die 58 on one side of the base 40, and die 58 on the opposite side of the base 40. Other embodiments have no substrate 82.

To facilitate package assembly, each base 40 also has a location protrusion 88 at each of its four corners to precisely position the lead on its top surface 50. Each of these protrusions 88 preferably has a rounded top surface to more easily make that connection. Accordingly, because they are injected molded parts, the lids 42 and bases 40 should fit together with small tolerances to produce generally planar exterior side faces 62C and 62D. It should be noted that minor differences in tolerances can produce a small discontinuity with any of the side surfaces 62C and 62D and still be within the spirit of various embodiments. In that case, it is anticipated that although part of the exterior side face 62C or 62D may be on a different plane than another part of its face 62C or 62D, both parts should be generally parallel to form one of the side faces 62C or 62D of the rectangular package 38.

Figure 5B:
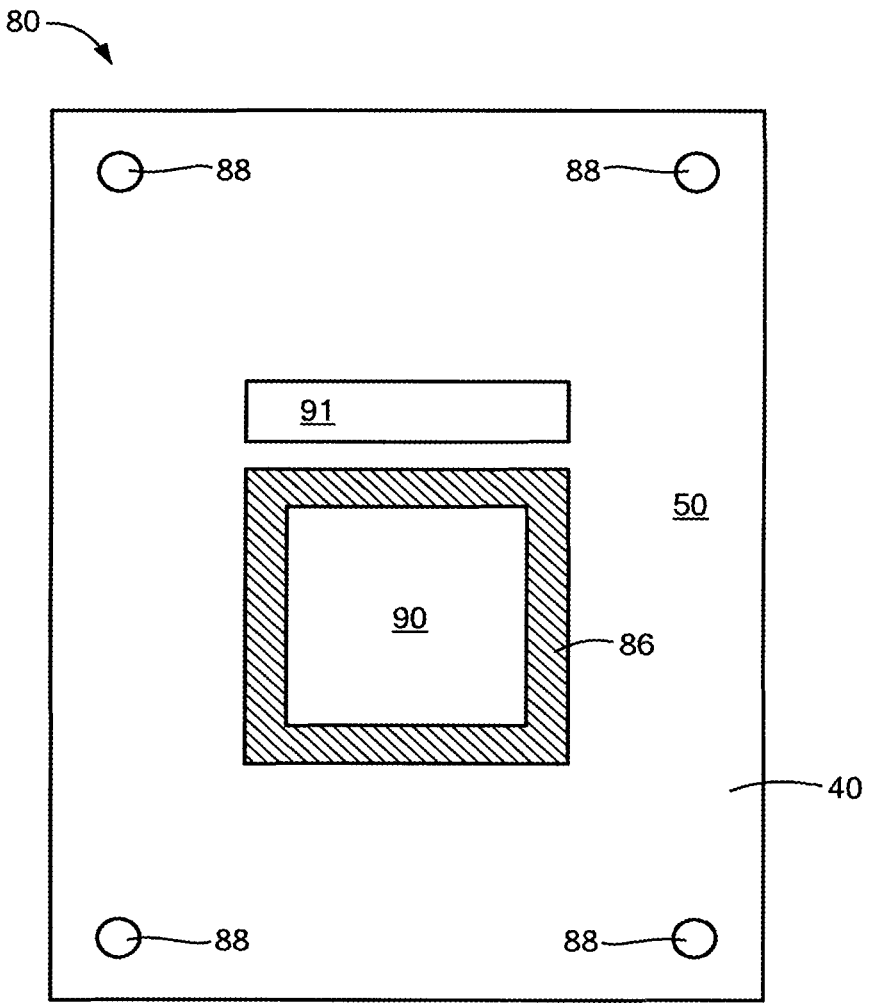
FIG. 5B schematically shows a base that may be used with the microphone of FIG. 3A.

FIG. 5B schematically shows a simplified plan view of the unitary base 80 highlighting the mounting pedestal 86 on the top side. In illustrative embodiments, the mounting pedestal 86 is a raised integral portion of its base 40. More specifically, in this embodiment, the mounting pedestal 86 essentially is formed by a continuous wall circumscribing a small channel through the base 40. The bottom of this small channel terminates at the above noted internal microphone input port 90, which acts an entry port to the acoustic channel 63 formed by the unitary base 80.

In fact, the top and bottom microphone input ports 90 preferably are symmetrically spaced (within reasonable design tolerances) with respect to the inlet port 54. In other words, the microphone input ports 90 of both bases 40 should receive an incoming acoustic signal at about the same time. As such, they should receive the input acoustic signal in phase. Alternative embodiments, however, do not make such as symmetrical configuration. Accordingly, when secured to the mounting pedestal 86, the microphone die 56 is in fluid communication with the inlet port 54 via the acoustic channel 63 formed by the unitary base 80 and its microphone input port 90.

The top and bottom microphone dies 56 preferably are mounted in a stacked relationship, and spaced apart in a direction that is generally orthogonal to the top face of the unitary base 80. As such, the diaphragms 68 of both microphone dies 56 are generally parallel to each other and are expected to receive many incoming acoustic signals at the same incident angle. More specifically, as suggested above, preferred embodiments position the top and bottom microphone dies 56 so that the diaphragms 68 of the two microphone dies 56 receive an incoming acoustic signal at substantially the same time.

To that end, if the mounting members are substantially the same height, then the microphone dies 56 may be mounted back-to-back, or front-to-front. Accordingly, these embodiments mount the two microphone dies 56 so that their backplates 66 are adjacent (i.e., the backplates 66 of both microphone dies 56 are between the two diaphragms 68), or so that their diaphragms 68 are adjacent (i.e., the diaphragms 68 of both microphone dies 56 are between the two backplates 66). Other embodiments may mount the microphone dies 56 in other manners, such as by mounting the diaphragm 68 of the bottom microphone die 56 adjacent to the backplate 66 of the top microphone die 56. In that case, the bottom microphone die 56 should be spaced farther away from the base 40 than the corresponding spacing of the top microphone die 56. In other words, regardless of the orientation or position of the microphone dies 56, to optimize performance, the two diaphragms 68 preferably are substantially symmetrically positioned (within reasonable design tolerances) relative to the input port 54 so that they receive the same signal at the same time. As such, they are about the same distance from the input port 54.

Other embodiments can orient the diaphragms 68 so that they do not receive the acoustic signals at substantially the same time. In those cases, the packaged microphone 17 may include further downstream circuitry that conditions and/or shifts the phase of the output of one or both of the microphone dies 56, thus providing the desired in-phase electronic output signals for subsequent processing.

The back volumes of the two microphone dies 56 may be connected (i.e., sharing back volume), or unconnected (i.e., having individual back volumes). To that end, FIG. 5B schematically shows one way of connecting the two back volumes using an opening 91 through both bases 40. Accordingly, both openings 91 in the unitary base 80 fluidly communicate the back volumes of each half of the package 38, effectively producing a single, large back volume.

Figure 6:
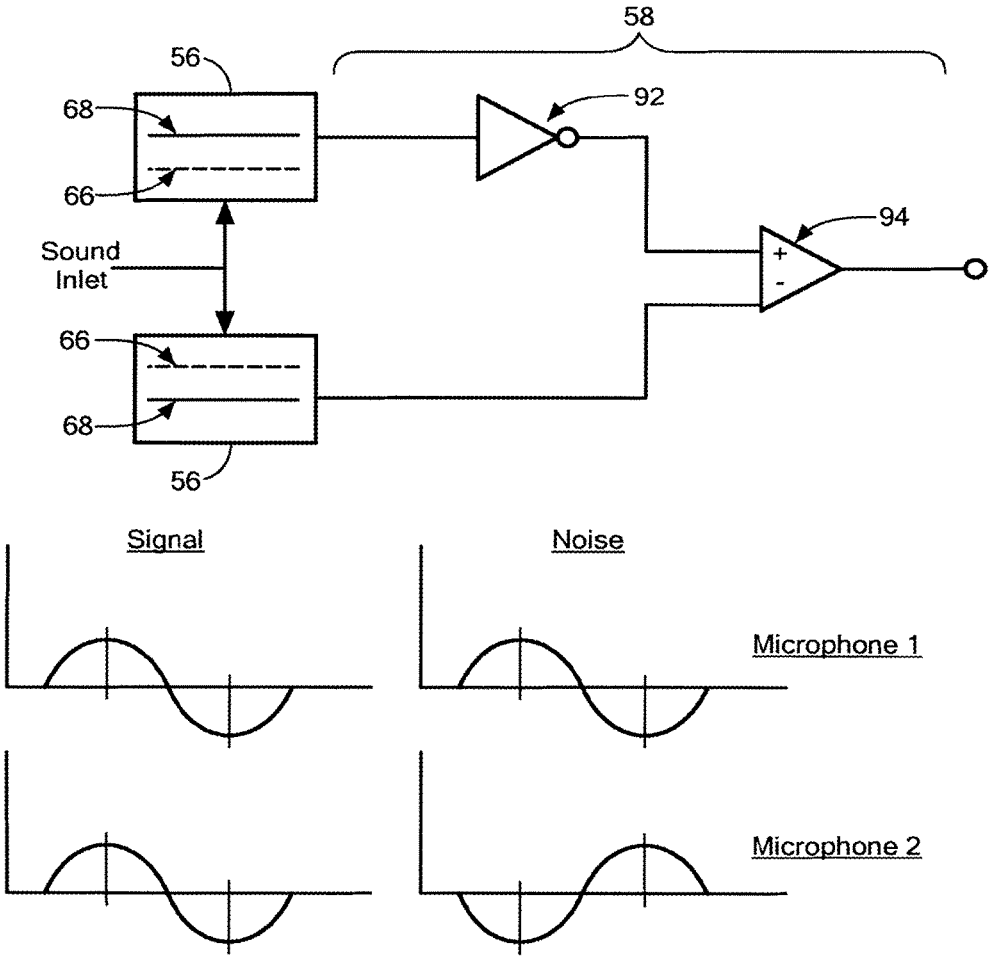
FIG. 6 shows a schematic circuit diagram of circuitry that may be used with the microphone of FIG. 3A.

FIG. 6 schematically shows a circuit implemented by the circuit die 58 in accordance with illustrative embodiments of the invention. Of course, this circuit is but one of a number of different circuits that may implement various embodiments. Accordingly, discussion of this circuit is not intended to limit all embodiments.

This figure also shows waveforms of the two microphone dies 56 in response to receipt of typical acoustic signals and noise signals. Specifically, when positioned properly, the microphone dies 56 should produce substantially the same, in phase desired signals in response to receipt of an input acoustic signal. In a similar manner, the inventors noticed that the two microphone dies 56 often produced substantially the same output noise signals in response to receipt of an input noise signal. For example, they produced the same output noise signals when subjected to vibrational noise. Specifically, vibrational noise is produced when the two diaphragms 68 are subjected to the vibrational or inertial signals. For example, the packaged microphone 17 is subjected to vibrational noise when a person using a hearing instrument 10 is walking, riding in a car, or doing push-ups. Another example is when a mobile telephone having the packaged microphone 17 is dropped. Moreover, the inventors also noticed that these output noise signals, produced by the two microphone dies 56, typically are 180 degrees out of phase.

Taking advantage of this discovery, the inventors developed the circuit of FIG. 6, which is a simplified version of an actual circuit that may be used. Specifically, the circuit includes the two microphone dies 56 receiving sound from the inlet port 54. For illustrative purposes only, the two microphone dies 56 show their backplates 66 as being adjacent to each other. Of course, as noted above, the microphone dies 56 can be in another orientation, such with their diaphragms 68 adjacent. The first microphone die 56 is coupled with an inverter 92, which inverts the output of the first microphone die 56, effectively shifting its phase by about 180 degrees. The output of the inverter 92 is fed into the positive input of a differential amplifier 94, while the output of the bottom microphone die 56 is fed into the negative input of the differential amplifier 94.

The inverter 92 causes the desired acoustic signals to be 180 degrees out of phase with each other, while, in contrast, it causes the noise signals to be in phase. Accordingly, the differential amplifier 94, which subtracts its negative input from its positive input, ideally produces an acoustic signal that is twice as large as either of the two input acoustic signals. As for the noise signals, since they are in phase after one is inverted, the differential amplifier 94 simply subtracts one from the other, substantially mitigating (e.g., eliminating) the vibrational noise signal from the output.

Figure 7:
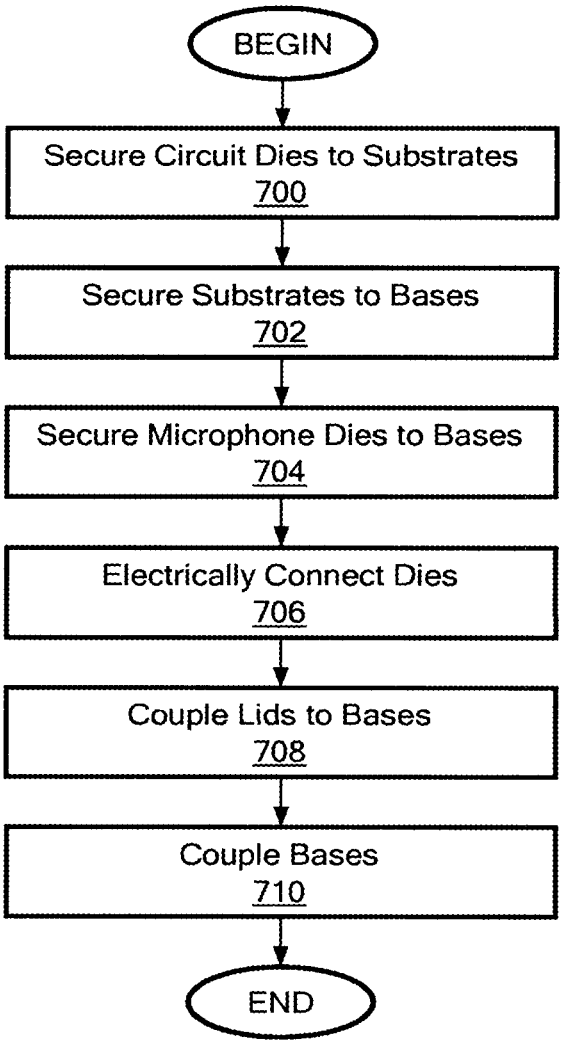
FIG. 7 shows a process of forming the packaged microphone of FIG. 3A in accordance with illustrative embodiments of the invention.

FIG. 7 shows a process of forming a packaged microphone, such as the microphone systems 17 shown in FIG. 3A, in accordance with illustrative embodiments of the invention. Although this process is discussed in terms of the microphone system 17 of FIG. 3A, it can be applied to other embodiments, such as others not explicitly discussed. It should be noted that this process is a simplified version of an actual fabrication process they can have many more steps. For example, this process may have a testing step, or additional steps for performing one of the noted steps. In addition, many of the steps of the process can be performed in a different order than that disclosed. For example, steps 702 and 704 can be performed in a different order. In fact, some steps can be performed at substantially the same time. Accordingly, this process is but one of many different illustrative processes that may implement various embodiments the invention.

It also is contemplated that illustrative embodiments of the process will be performed using batch production processes. In other words, the process typically may be completed on a plurality of microphone systems 17 at the same time—in parallel. Accordingly, discussion of fabricating a single microphone system 17 is for simplicity purposes only.

The process begins at step 700, which secures the circuit dies 58 to the substrates 82 by any of a number of conventional methods. For example, the method may apply a conventional adhesive or die attach epoxy between the bottom of the circuit die 58 and the top of the substrate 82. Alternatively, the circuit die 58 may form a flip-chip connection onto the substrate 82.

Next, the process secures the substrates 82 with their secured circuit dies 58 to their bases 40. Again, in a manner similar to the process of securing the circuit die 58, the substrate 82 may be secured to the base 40 by any of a number of conventional methods, such as using a thermal adhesive, or epoxy tape.

Step 704 then secures the microphone dies 56 to their mounting pedestals 86/bases 40 by any of a number of conventional methods, such as those described above with regard to the circuit die 58 (e.g., using a die attach epoxy). In alternative embodiments, the microphone dies 56 may be formed from a single die—i.e., they have a common substrate. Such alternative embodiments may require different package components, but should reduce overall package size.

After securing both the microphone die 56 and circuit die 58 to the bases 40, step 706 electrically connects both dies together, and to the base 40. Among other ways, the method may use a conventional wire bond 81 connecting between the two dies. Alternatively or in addition, each die 56 and 58 may have a wire bond 81 connecting to the substrate 82 or some other electrical conductor on the base 40. In yet another embodiment, one or both of the dies are flip-chip connected to the substrate 82. Those skilled in the art can use combinations of these noted electrical connection techniques, or others conventionally known techniques that are not discussed, to make the required electrical connections.

At this stage in the process, the bases 40 are substantially complete. Accordingly, step 708 couples the lids 42 to the bases 40. To that end, conventional processes place the lids 42 onto the bases 40 so that the base location protrusions 88 relatively closely contact the inner surface of the lid side walls 44. More specifically, each location protrusion 88 of the base 40 is positioned at one open corner of the lid 42 to provide a precise connection with minimal discontinuities on the side exterior surfaces 62C and 62D. The location protrusions 88 thus precisely guide and position the lid 42 onto the base 40. Again, as with other steps, conventional techniques may secure the base 40 to the lid 42. For example, the process may use a conventional epoxy to connect the lid 42 and the base 40.

As shown in FIG. 3C, each substrate 82 is sandwiched between a portion of its base 40 and the lid 42 as it extends between the interior and exterior of the package 38. This can present a challenge for sealing the interior chamber 43. To meet this design concern, in illustrative embodiments, the lid 42 or base 40 has an indented portion to accommodate the extra thickness that the substrate 82 adds to the base 40 where it exits the interior chamber 43. Accordingly, the adhesive should sufficiently seal that side of the lid 42 against both the base 40 and the substrate 82 to the extent necessary. In illustrative embodiments, the seal between the base 40 and the lid 42 is at least sufficient to prevent direct signal access to the interior chamber 43 other than though the inlet port 54.

Of course, other techniques may connect the lid 42 to the base 40. For example, the process may ultrasonically weld the lid 42 to the base 40, and use some additional process to connect and seal the lid 42 and the substrate 82.

The process concludes at step 710, which couples the two bases 40 together as discussed above. Again, conventional adhesive, ultrasonic welding, or other known processes may couple the bases 40 together to form the unitary base 80.

Of course, some embodiments may vary from those discussed above and are within the skill of those in the art to construct. For example, rather than use two separate bases 40, some embodiments use a single base 40, thus eliminating some of the fabrication steps (e.g., step 710).

Alternative embodiments may orient and/or configure the microphone dies 56 so that (sometimes or all the time) only one microphone die 56 receives the incoming acoustic signal, and both receive the vibration signal. For example, one of the microphone dies 56 may be capped, or be oriented out of the acoustic path. Accordingly, only one microphone die 56 may provide the requisite signal, while the other primarily provides noise mitigation due to the vibrational noise. This can enable the microphone die 56 receiving the signal to be mounted in a more favorable orientation to the direction of the incoming acoustic signal (e.g., to directly receive the signal).

Accordingly, illustrative embodiments orient and configure their internal microphone dies 56, and configure their downstream circuitry 58 so that they significantly enhance the desired acoustic signal output while substantially mitigating certain known kinds of noise signals. Moreover, illustrative embodiments deliver this improved performance in a smaller footprint, and/or in a side port design, either of which can be used with devices having significant space constraints, such as mobile telephones or hearing instruments 10A, 10B.

Although the above discussion discloses various exemplary embodiments of the invention, it should be apparent that those skilled in the art can make various modifications that will achieve some of the advantages of the invention without departing from the true scope of the invention.

What is claimed is:

1. A microphone package comprising:

a lid with side walls, each side wall having an inner surface, one of the side walls of the lid having a specially-shaped contour to receive a complementary upwardly extending portion of a base, the upwardly extending portion of the base forming a portion of an audio input port;

an interior chamber; and the base and the lid forming the interior chamber, wherein the audio input port enables ingress of audio signals into the interior chamber, the base having, a circuit die, a plurality of location protrusions, each positioned along an edge of the base to precisely guide and position the lid onto the base.

2. The microphone package of claim 1, wherein the base further includes interconnects.

3. The microphone package of claim 2, wherein the interconnects include wire bonds.

4. The microphone package of claim 2, wherein the interconnects extend through the base or the lid and terminate at exterior interconnects positioned on a bottom, top and/or side faces of the microphone package.

5. The microphone package of claim 1, further including a substrate having the circuit die secured thereto, and wherein the base includes the substrate and the substrate extends to an edge of the base from within the interior chamber to an exterior side face of the microphone package.

6. The microphone package of claim 1, wherein the substrate has a plurality of internal pads, the plurality of internal pads electrically coupling the substrate to the circuit die.

7. The microphone package of claim 6, wherein the base further includes a microphone die and wherein the internal pads array electrically couple the substrate to the microphone die.

8. The microphone package of claim 1, wherein the base includes a microphone die coupled to the circuit die through interconnects.

9. The microphone package of claim 1, wherein the substrate has a plurality of external pads configured to mount the substrate to an external device.

10. The microphone package of claim 1, wherein the location protrusions each have a rounded top surface.

11. The microphone package of claim 1, wherein the base includes a microphone die and configured to support the microphone die on a side of the base, the base further configured to support the circuit die on an opposite side of the base.

12. The microphone package of claim 1, wherein the base further has a second substrate and a microphone die, the substrate configured to support the microphone die or the circuit die and the second substrate configured to support one of the microphone die and circuit die not supported by the substrate.

13. The microphone package of claim 1, wherein the base has a generally flat region configured to support a part of the substrate onto which the circuit die is formed.

14. The microphone package of claim 1, wherein the base includes a microphone die and a mounting pedestal, the mounting pedestal being configured to support the microphone die.

15. The microphone package of claim 1, wherein the base is formed from two complementary bases, a top base and a bottom base, the two complementary bases positioned back-to-back and secured together to form the audio input port, wherein the base is configured to support components on a top and a bottom surfaces of the base, wherein the bottom surface is a part of the top base and includes a plurality of locking members or a prescribed pattern of bumps, wherein the top surface is a part of the bottom base and includes a corresponding pattern of locking apertures, wherein the corresponding pattern of locking apertures are lined up with the plurality of locking members.

16. The microphone package of claim 15, wherein, the top and bottom surfaces have an identical arrangement of components.

17. The microphone package of claim 1, wherein the base includes a microphone die.

18. The microphone package of claim 17, wherein the microphone die is a Microelectromechanical systems (MEMS) microphone die.

19. The microphone package of claim 1, further including a substrate formed of a circuit board material or a flex circuit board.

20. The microphone package of claim 1, wherein the lid has location protrusions positioned in relatively close contact with an inner surface the lid.

21. The microphone package of claim 1, further including an epoxy used to connect the lid and the base.

22. The microphone package of claim 1, wherein the circuit die is secured to a substrate and the substrate is positioned on the base.

23. The microphone package of claim 1, wherein the lid and the base are ultrasonically welded to each other.

24. The microphone package of claim 1, wherein the lid and the substrate are sealed.

25. A method of making a microphone package comprising:

securing a plurality of circuit dies to a plurality of substrates;

securing the plurality of substrates to a plurality of bases;

securing a plurality of microphone dies to the plurality of bases;

electrically coupling the plurality of circuit dies and the plurality of microphone dies;

coupling a plurality of lids to the plurality of bases, wherein each of the plurality of lids together with a corresponding one of the plurality of bases forms an interior chamber;

coupling the plurality of bases to each other; and forming side walls for each of the plurality of the bases, each side wall having an inner surface;

forming a specially-shaped contour from one of the side walls of one of the plurality of the lids;

the specially-shaped contour receiving a complementary upwardly extending portion of one of the plurality of the bases;

the upwardly extending portion forming a portion of an audio input port to enable ingress of audio signals into the interior chamber.

26. The method of making a microphone package of claim 25, wherein the coupling a plurality of lids step includes ultrasonically welding the plurality of lids to the plurality of bases and subsequently sealing the plurality of lids and the plurality of substrates.

27. The method of making a microphone package of claim 25, further including coupling the plurality of circuit dies and the plurality of microphone dies to the plurality of lids.

* * * * *